United States Patent [19]

Hong

[11] Patent Number: 4,896,900

[45] Date of Patent: Jan. 30, 1990

[54] LOOSE-LEAF PHOTO ALBUM

[75] Inventor: Wu-Hsin Hong, Tainan, Taiwan

[73] Assignee: Hsin Yu Album Enterprise Co., Ltd., Tainan, Taiwan

[21] Appl. No.: 257,325

[22] Filed: Oct. 13, 1988

[51] Int. Cl.[4] ..... B42D 5/00; G09F 19/00; B05D 11/00

[52] U.S. Cl. ..... 281/15.1; 40/530; 16/222

[58] Field of Search ..... 402/26, 27, 28, 30; 281/15 R; 16/254, 227, 235, 356, 259, 387, DIG. 13, DIG. 33, DIG. 24; 40/13, 119, 446, 530; 403/52

[56] References Cited

U.S. PATENT DOCUMENTS

| | | | |
|---|---|---|---|
| 2,776,521 | 1/1957 | Zimmerman | 16/DIG. 13 |
| 3,952,369 | 4/1976 | Erickson | 16/DIG. 13 |
| 4,180,341 | 12/1979 | Langhorst | 40/530 |
| 4,408,430 | 10/1983 | Wangler | 16/DIG. 13 |
| 4,601,489 | 7/1986 | Stancato | 40/530 |
| 4,713,861 | 12/1987 | Bancroft | 16/222 |

FOREIGN PATENT DOCUMENTS

| | | | |
|---|---|---|---|
| 1125350 | 11/1984 | U.S.S.R. | 16/254 |

*Primary Examiner*—Douglas D. Watts
*Assistant Examiner*—Paul M. Heyrana, Sr.
*Attorney, Agent, or Firm*—Ladas & Parry

[57] ABSTRACT

This invention discloses a loose-leaf binder such as a loose-leaf photo album or a loose-leaf file binder, which is disposed a plurality of hinge members having a pillar at one end and an axially concave knuckle at the other end. A slit is formed on the outer wall of the concave knuckle so that a pillar may be inserted into the concave knuckle therefrom. When the assembly is completed, a single page of the photo album or file is created. With the addition of many single pages, a complete photo album or file is formed. The hinge members of the pages of this loose-leaf binder may be easily attached and detached so as to increase or decrease the number of pages of the binder as desired.

9 Claims, 5 Drawing Sheets

LOOSE-LEAF PHOTO ALBUM

BACKGROUND OF THE INVENTION

This invention relates to a loose-leaf binder, and more particular to a loose-leaf binder, such as a loose-leaf photo album or a loose-leaf file binder, having a plurality of pages neatly piled together, every abutting two of which are detachably and rotatably connected to each other by a plurality of axially aligned hinge members alternately formed along a pair of corresponding edges of said pages.

In FIG. 1, a conventional loose-leaf binder which is sold in the mark is shown. This conventional loose-leaf binder comprises a plurality of pages (A) neatly piled together, every abutting two of which are detachably and rotatably connected to each other by a set of hinge members (B) comprising a plurality of axially aligned hinge seats (B1) alternately formed along a pair of corresponding edges of the abutting two pages. However, the user of this conventional loose-leaf binder has to prepare a number of hinge wires which are apt to injure his/her fingers and are also difficult to insert into the axially aligned hinge seats as they are curved and/or the hinge seats are not precisely aligned or manufactured.

SUMMARY OF THE INVENTION

Therefore, it is a primary object of this invention to provide a loose-leaf binder which is capable of overcoming the above-mentioned known disadvantages of the prior art.

According to this invention, a loose-leaf binder has a plurality of pages neatly piled together, every abutting two of which are detachably and rotatably connected to each other by a plurality of axially aligned hinge members alternately formed along a pair of corresponding edges of said pages; wherein the improvement is characterized in that: every neighboring two of the axially aligned hinge members are rotatably engaged with each other by an axially concave knuckle and an axially protruded pillar which are respectively formed at said hinge members' adjacent axial ends, said axially concave knuckle also has an outer wall formed by one of said adjacent ends, said wall having a longitudinal slit extending from the end having said concave knuckle, and said axially protruded pillar being adapted to be inserted into and received within said concave knuckle via said longitudinal slit.

Another object of the invention is to provide a loose-leaf page comprising a piece of cardboard which has an edge having a plurality of first hinge members and a plurality of second hinge members alternately formed on the two sides along said edge, so that a similar page with similar hinge members can be rotatably connected with said loose-leaf page by engaging its second hinge members with the first hinge members of said loose-leaf page; wherein the improvement is characterized in that: said first and second hinge members respectively have two end portions, one part of said end portions respectively having an axially concave portion defined by a wall formed therearound, constituting an axially concave knuckle, said wall also having a longitudinal slit extending from said knuckle's free end, traversely passing through said wall and connecting with said axially concave portion, and the rest of said end portions respectively having a pillar axially protruded therefrom, said pillar being adapted to be inserted into a corresponding knuckle of a similar loose-leaf page via said longitudinal slit.

Other objects of the invention will become apparent and the invention readily understood from the follow description read in conjunction with the accompanying drawings in which:

DETAILED DESCRIPTION OF THE PREFERRED EMBODIMENT

Figure 1:
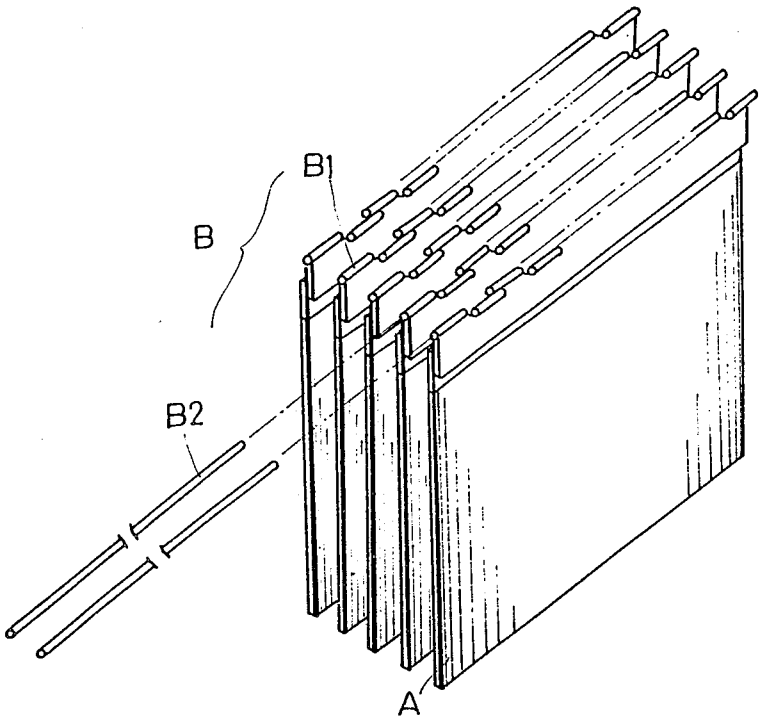
FIG. 1(PRIOR ART)
FIG. 1 is an exploded perspective view of a conventional loose-leaf binder.
Figure 2:
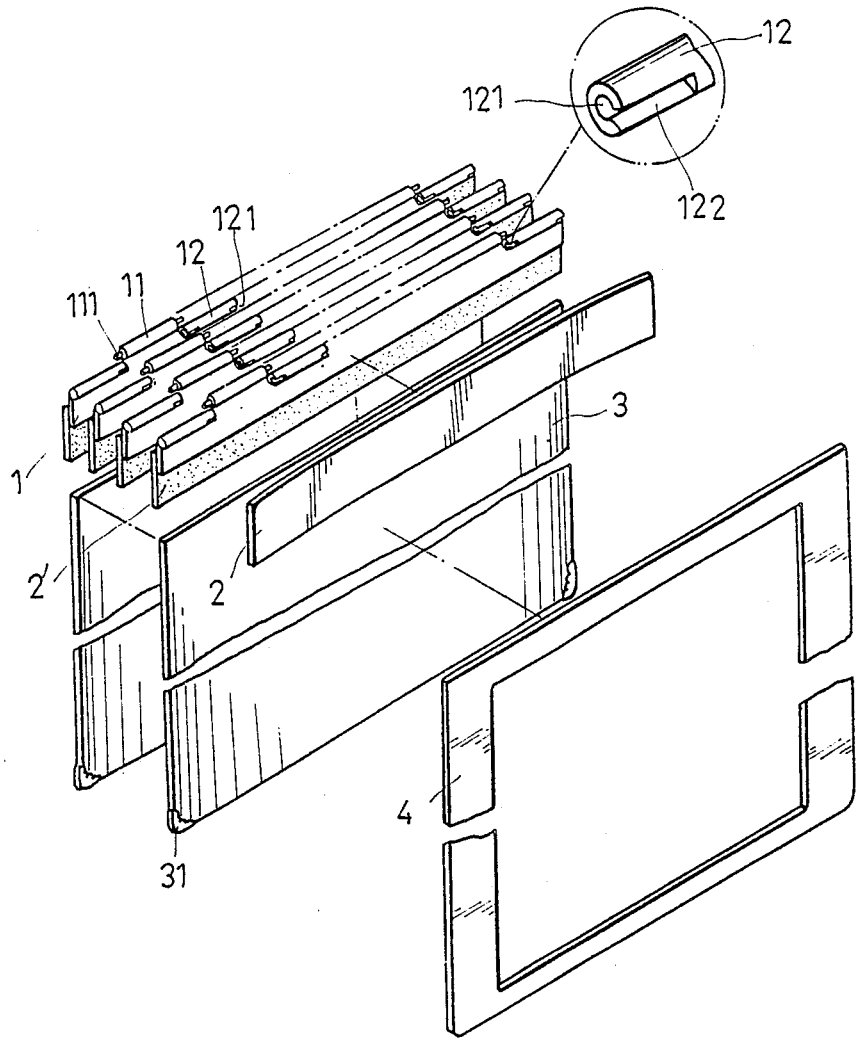
FIG. 2 is an exploded perspective view of a loose-leaf binder according to this invention.

Referring now to FIG. 2, a loose-leaf binder is shown, which comprises loose-leaf pages 1, a pair of tapes 2, 2', a content page 3 and a photo strut 4. The loose-leaf pages 1 are made of a plastic material which is integrally formed as a longitudinal plate. On the loose-leaf pages 1 are disposed a plurality of first hinge members 11 and a plurality of second hinge members 12 alternately formed on the two sides and along the edge of said loose-leaf. A pair of pillars 111 are respectively formed at the two sides of the first hinge member 11. Moreover, a pair of axially concave knuckles 121 are disposed along the two sides of the second hinge member 12. In addition, a longitudinal slit 122 extends from the free end of the axially concave knuckle 121, traversely passing through the wall of said knuckle and connecting with said knuckle 121. The slit 122 is substantially tapered, and has an opening of which is gradually enlarged, radially from a first end of the longitudinal slit 122 which abuts with the axially concave knuckle 121, to a second end of the same, which is opposite to the first end, finally forming a passage way which is adapted to receive the axially protruded pillar 111. The slit 122 is adapted to be passed through the axially protruded pillar 111 so that said pillar may be received within the axially concave knuckle 121. Thus, A loose-leaf binder has a plurality of neatly piled pages, every abutting two of which are detachably and rotatably connected to each other by a plurality of axially aligned hinge members 11, 12, alternately formed along a pair of corresponding edges of said pages; Every neighboring two of said axially aligned hinge members 11, 12 are detachably and rotatably engaged with each other by an axially concave knuckle 121 and an axially protruded pillar 111 which are respectively formed at their adjacent axial ends. The axially concave knuckle 121 has an outer wall formed by one of said adjacent ends, defining a concave portion, the wall having a longitudinal slit 122 extending from the free end of the concave knuckle 121, traversely passing through the wall and connecting with the concave portion of said knuckle, and said axially protruded pillar 111 being adapted to be inserted into the concave knuckle 121 via said longitudinal slit 122.

Figure 3:
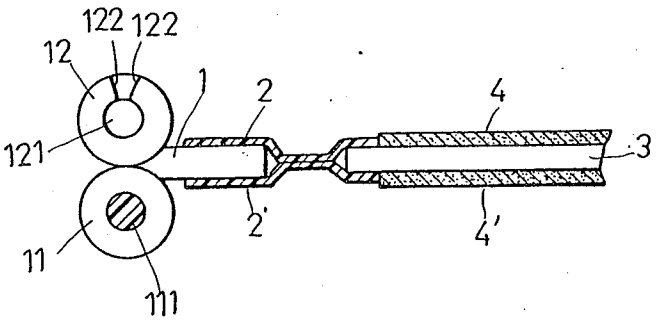
FIG. 3 is a schematic view of a single loose-leaf page which has been assembled according to FIG. 2.

Referring again to FIG. 2, a content page 3 is substantially a rectangular page with gold foil attached to its margins. In addition, as shown in FIG. 3, two layers of a cardboard-like material 2, 2', the joining surfaces of which are coated with a glue-like substance, are separated at one edge and simultaneously and tightly attached via said glue-like substance, to both the loose-leaf pages 1 and the content page 3. Thus, the loose-leaf pages 1 and the content page 3 are integrally formed. A pair of receiving pockets are respectively provided on the upper and the lower portions of the content page 3 in order to receive photos.

Figure 4:
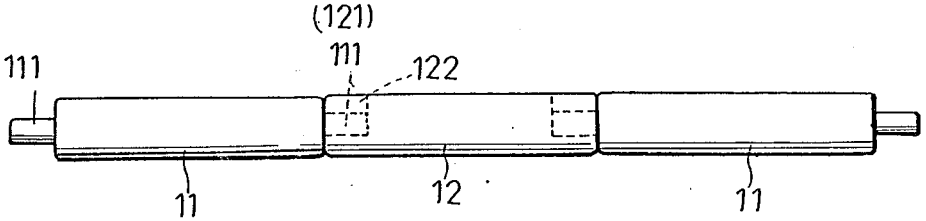
FIG. 4 is a schematic view of the hinge members which are assembled by means of insertion of the pillar into the openings through a slit.

Referring now to FIG. 4, assembly of a plurality of hinge members is provided. Every neighboring two of the axially aligned hinge members 11, 12 are rotatably engaged with each other by an axially concave knuckle 121 and an axially protruded pillar 111 which are respectively formed at their adjacent axial ends. The axially concave knuckle 121 has an outer wall formed by one of the adjacent ends, the wall having a longitudinal slit 122 extending from the free end of the concave knuckle 121, and the axially protruded pillar 111 being adapted to be inserted into the concave knuckle 121 via said longitudinal slit 122.

Figure 5:
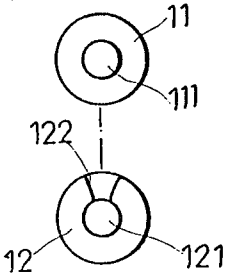
FIG. 5 is a sectional view of a pair of hinge members of FIG. 4.

Referring to FIG. 5, a sectional view of a pair of hinge members 11, 12 is shown. The hinge members 11, 12 are made of a flexible material and the opened space of the first end of the hinge members is smaller than every orthographically projected space of the traverse cross-section of the protruded pillar 111 so that the axially protruded pillar 111 can be snapped into and stably received within the axially concave portion of the knuckle 121, via the longitudinal slit 122.

Figure 6:
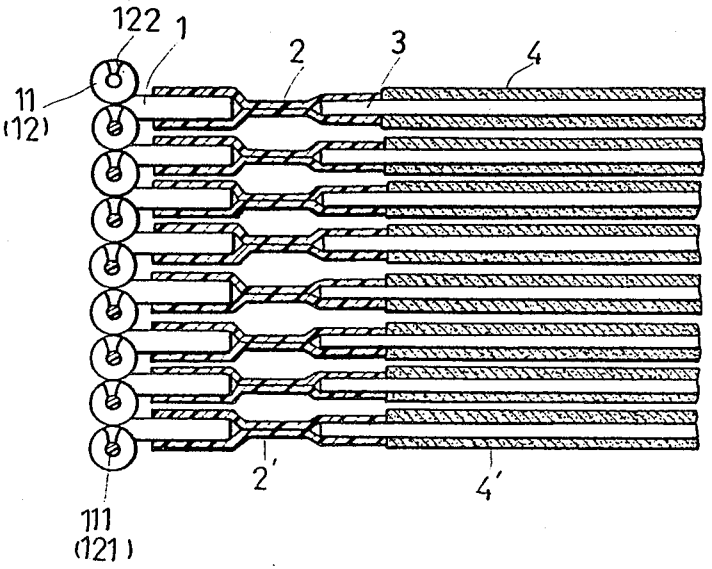
FIG. 6 is a schematic view of a plurality of loose-leaf pages which have been assembled and overlapped together.

Referring to FIG. 6, a plurality of loose-leaf pages are overlapped and piled together. Each loose-leaf page 1 comprises a piece of cardboard which has an edge with a plurality of first hinge members 11 and a plurality of second hinge members 12 alternately formed on the two sides along said edge, so that a similar page with similar hinge members can be rotatably connected with a loose-leaf page 1 and another of said similar pages can be rotatably connected with a loose-leaf page 1 by engaging its second hinge members 12 with the first hinge member 11 of one of said loose-leaf pages. Wherein the first and second hinge members 11, 12 respectively have two end portions, one part of the end portions respectively having an axially concave portion defined by a wall formed therearound, constituting an axially concave knuckle 121, the wall further having a longitudinal slit 122 extending opened from its free end, traversely passing through said wall and connecting with the axially concave portion, and the rest of the end portions respectively having a pillar 111 axially protruded therefrom, the pillar 111 being adapted to be inserted into a corresponding knuckle 121 of a similar loose-leaf page via said longitudinal slit 122. Thus, a photo album of this invention is complete when all the loose-leaf pages 1 with hinge members are rotatably piled together.

Figure 8:
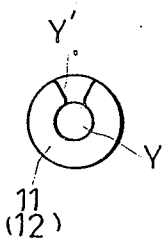
FIG. 8 is a sectional view of a hinge member of FIG. 7.
Figure 7:
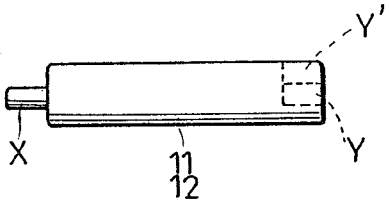
FIG. 7 is a schematic view of a hinge member of another embodiment assembled according to the invention.
Figure 9:
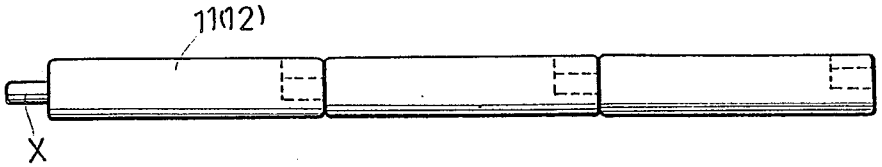
FIG. 9 is a schematic view of the hinge members of another embodiment assembled according to this invention.

Referring to FIG. 7, another embodiment according to this invention in which a hinge member 11 with a pillar X at one end and a concave knuckle Y, having a slit Y' at the other end, is shown. In FIG. 8, a sectional view of a hinge member is provided. Referring to FIG. 9, each hinge member can be engaged with another hinge member by the insertion of a pillar X into another concave knuckle through the slit Y'. According to the method of the above-mentioned first embodiment, together with hinge members of the second embodiment, a complete photo album may be created.

The above embodiment is given by way of example only and various modifications may be made without departing from the scope of the invention.

What is claimed is:

1. A loose-leaf binder having a plurality of pages neatly piled together, every abutting two of which are detachably and rotatably connected with each other by a plurality of axially aligned hinge members alternately formed along a pair of corresponding edges of said pages; wherein the improvement is characterized in that every neighboring two of the axially aligned hinge members are detachably and rotatably engaged with each other by an axially concave knuckle and an axially protruded pillar which are respectively formed at the adjacent axial ends, said axially concave knuckle having an outer wall formed by one of said adjacent ends and defining a concave portion, said wall having a longitudinal slit extending from the free end of said concave knuckle, tranversely passing through said wall and connecting with said knuckles' concave portion, and said axially protruded pillar being formed to be inserted into said concave knuckle via said longitudinal slit.

2. A loose-leaf binder as claimed in claim 1, wherein said longitudinal slit is tapered, the opening of which is gradually enlarged radially from a first end of said longitudinal slit, which abuts with said axially concave knuckle, to a second end of the same, which is opposite to said first end, finally forming a passageway which is configured to receive said axially protruded pillar.

3. A loose-leaf binder as claimed in claim 2, wherein said hinge members are made of a flexible material and the opened width of their first end is smaller than every orthographically projected width of the traverse cross-section of said protruded pillar, so that the axially protruded pillar can be snapped into and stably received within said axially concave knuckle via said longitudinal slit.

4. A loose-leaf page comprising a piece of cardboard which has an edge having a plurality of first hinge members and a plurality of second hinge members alternately formed on the two sides along said edge, so that a similar page with similar hinge members can be rotatably connected with said loose-leaf page by engaging its first hinge members with the second hinge members of said loose-leaf page and another of said similar pages can be rotably connected with said loose-leaf page by engaging its second hinge members with the first hinge members of said loose-leaf page, wherein the improvement is characterized in that: said first and second hinge members respectively have two end portions, one part of said end portions respectively having an axially concave portion defined by a wall formed therearound, constituting an axially concave knuckle, said wall further having a longitudinal slit extending from the knuckles' free end, traversely passing through said wall and connecting with said axially concave portion, and the rest of said end portions respectively having a pillar axially protruded therefrom, said pillar being constructed to be inserted into a corresponding knuckle of a similar loose-leaf page via said longitudinal slit.

5. A loose-leaf page as claimed in claim 4, wherein said longitudinal slit is tapered, the opening of which is gradually enlarged radially from the first end of said longitudinal slit which abuts with said axially concave knuckle, to a second end of the same, which is opposite to said first end, finally forming a passageway adapted to receive a corresponding axially protruded pillar of a similar loose-leaf page.

6. A loose-leaf page as claimed in claim 5, wherein said hinge members are made of a flexible material and the opened width of said first end of said hinge members is smaller than every orthographically projected width of the traverse cross-section of said protruded pillar, so that the axially protruded pillar can be snapped into and stably received within a corresponding axially concave knuckle's of a similar loose-leaf page via said knuckle's axially concave portion.

7. A loose leaf binding component for connecting pages, said component comprising:

first hinge members;

second hinge members, said first hinge members and said second hinge members alternately fixed along the two sides of an edge of the page;

pillars formed on each end of said first hinge member; and axially concave knuckles formed at the ends of said second hinge members, said concave knuckles having a longitudinal slit extending from each free end of said knuckles, said slit having a taper which enlarges said slit toward an outer surface of said second hinge members cooperating with an adjacent pillar of a first hinge member of an adjacent component so that the first hinge member of the adjacent component can be rotatably engaged with the second hinge member of the first mentioned component by insertion of said pillar into the axially concave knuckle of the adjacent component.

8. A component as claimed in claim 7 wherein said slit has a taper which enlarges said slit toward an outer surface of said second hinge member.

9. A component as claimed in claim 8 wherein said first and second hinge members are made of a flexible material.

* * * * *